US005154645A

United States Patent [19]

Harada et al.

[11] Patent Number: 5,154,645

[45] Date of Patent: Oct. 13, 1992

[54] BULB SOCKET

[75] Inventors: Tadashi Harada, Shizuoka; Kazuya Horiuchi, Mie, both of Japan

[73] Assignees: Koito Manufacturing Co., Ltd., Tokyo; Sumitomo Wiring Systems, Ltd., Mie, both of Japan

[21] Appl. No.: 665,845

[22] Filed: Mar. 7, 1991

[30] Foreign Application Priority Data

Mar. 12, 1990 [JP] Japan ..... 2-24722[U]

[51] Int. Cl.[5] ..... H01R 13/405

[52] U.S. Cl. ..... 439/736; 439/336

[58] Field of Search ..... 434/336, 335, 736, 854, 434/857, 851, 855, 859, 340, 918

[56] References Cited

U.S. PATENT DOCUMENTS 4,588,248 5/1986 Moore ..... 439/336
4,804,343 2/1989 Reedy ..... 439/854
4,871,331 10/1989 Kondo et al. ..... 439/736
5,035,643 7/1991 Forish et al. ..... 439/354

FOREIGN PATENT DOCUMENTS 2361314 6/1974 Fed. Rep. of Germany ..... 439/336

*Primary Examiner*—Neil Abrams
*Assistant Examiner*—Hien D. Vu
*Attorney, Agent, or Firm*—Sughrue, Mion, Zinn, Macpeak & Seas

[57] ABSTRACT

A bulb socket in which a positive terminal and an earth terminal are embedded in a socket body during the injection molding which body having a bulb insertion hole and a connector connection hole. The bulb socket is provided with a mold insertion space portion formed between a peripheral wall of the socket body constituting the bulb insertion hole and a bulb contact hole of the earth terminal.

8 Claims, 4 Drawing Sheets

BULB SOCKET

BACKGROUND OF THE INVENTION

1. Industrial Field

The present invention relates generally to a bulb socket and method for molding same for use in a motor vehicle lamp or the like, and more particularly to a bulb socket of a so-called direct-connecting type having a bulb insertion portion and a connector insertion portion and in which a positive terminal and an earth terminal are partially embedded in the body integrally as the body of the socket is molded.

2. Related Art

In the conventional manufacture of a bulb socket of this type as disclosed in co-assigned U.S. Pat. No. 4,871,331, it is necessary to prevent molten resin from flowing into a bulb insertion hole which is brought into direct electrical contact with the lead wire of a bulb. In this case, if a part of the terminals is used as a part of a die for molding a socket body, the structure of the die can be simplified.

However, if the part of the terminals is used as the part of the die for molding the socket body, a bulb contact portion of the earth terminal is liable to be deformed by the pressure of the molten resin during the molding thereby decreasing the yield rate of products, because the contact portion of the earth terminal is particularly thin, flattened in shape, and extends a long distance to an upper portion.

SUMMARY OF THE INVENTION

In view of the deficiencies accompanying the conventional bulb socket and method of molding the same, it is an object of the present invention to provide a bulb socket which is free from the possibility of deformation of a bulb contact portion of an earth terminal due to resin pressure during molding in a die.

It is another object of the invention to provide a method of molding a socket body with a die without deforming a bulb contact portion of an earth terminal due to resin pressure during the molding.

The above and other objects of the invention can be achieved by a provision of bulb socket which, according to the invention, is provided with a positive terminal and an earth terminal are embedded in a body of a socket having a bulb insertion hole, a connector connecting portion, and a die insertion space formed between a peripheral wall of the socket body constituting the bulb insertion hole and a bulb contact portion of the earth terminal.

DESCRIPTION OF THE PREFERRED EMBODIMENTS

The preferred embodiments of the present invention will now be described in detail with reference to accompanying drawings.

Figure 1:
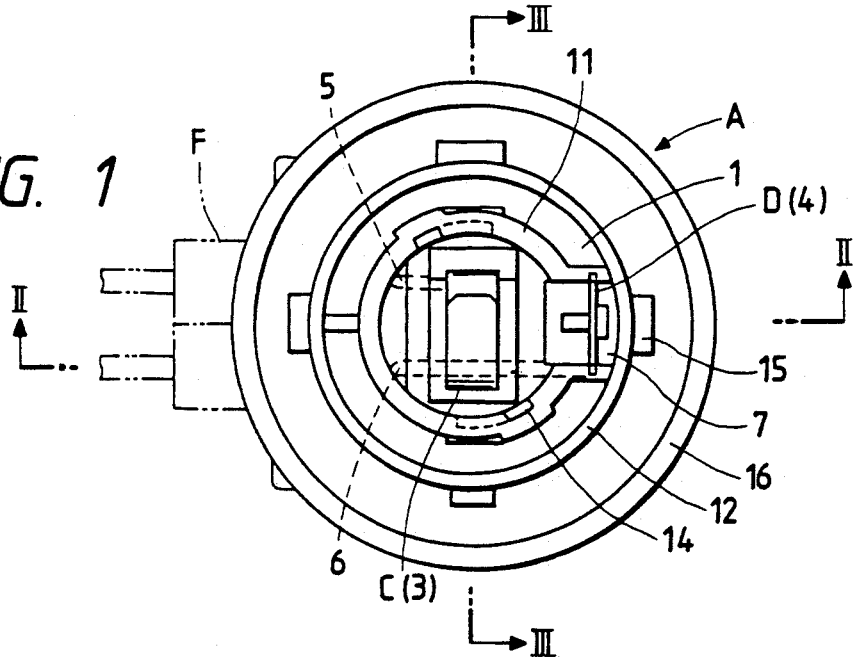
FIG. 1 is a plan view of a valve socket according to a first embodiment of the present invention.
Figure 2:
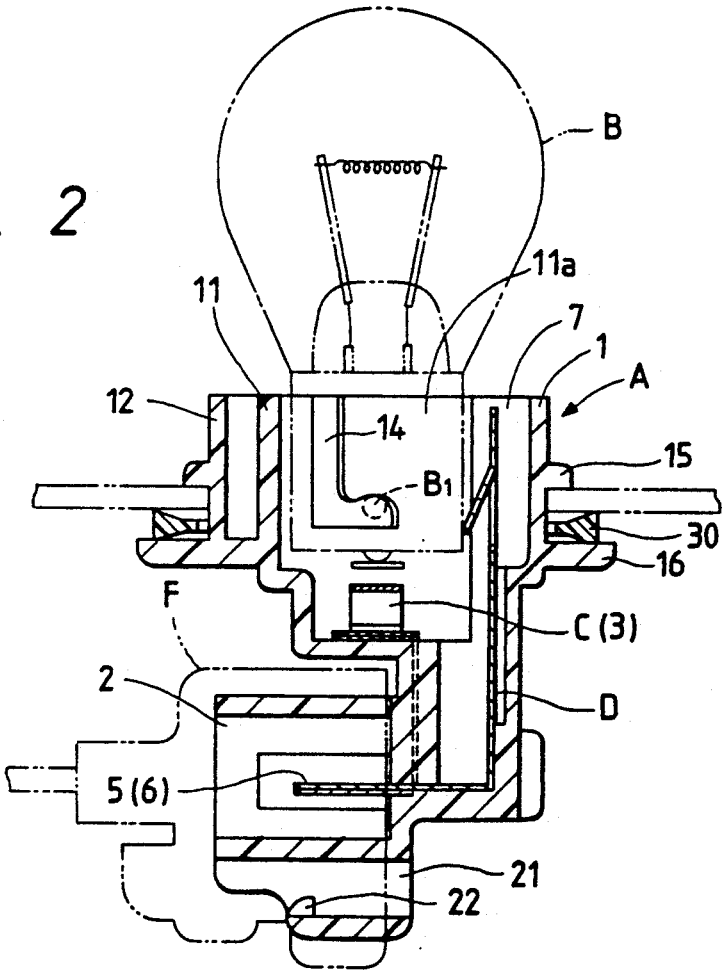
FIG. 2 is a cross-sectional view taken along the line II—II of FIG. 1 with a bulb and a connector.
Figure 3:
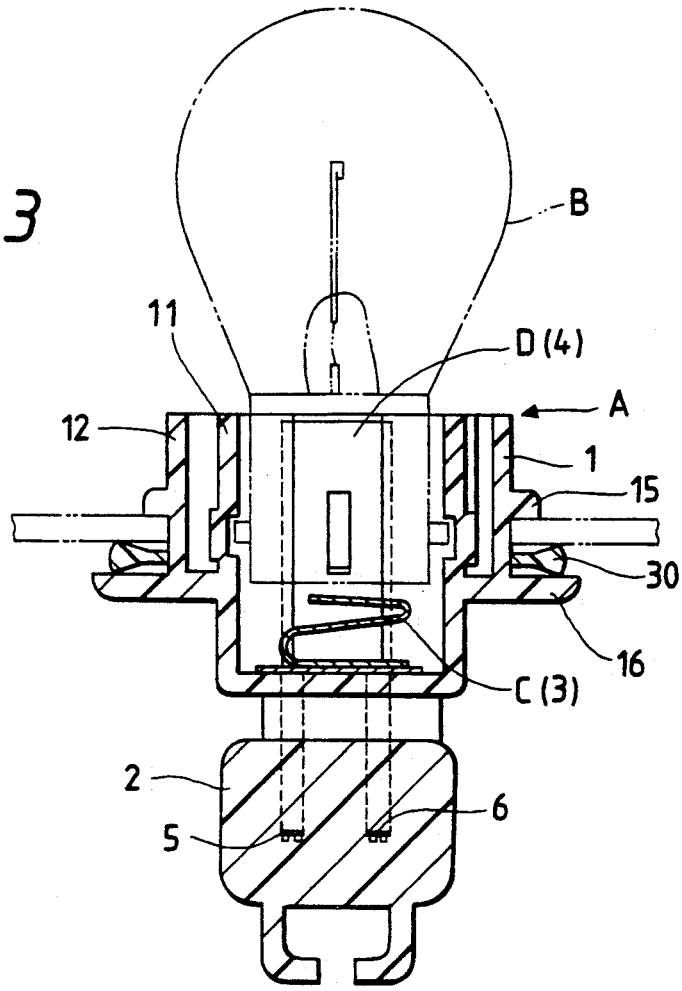
FIG. 3 is a cross-sectional view taken along the line III—III of FIG. 1 with the bulb.
Figure 4:
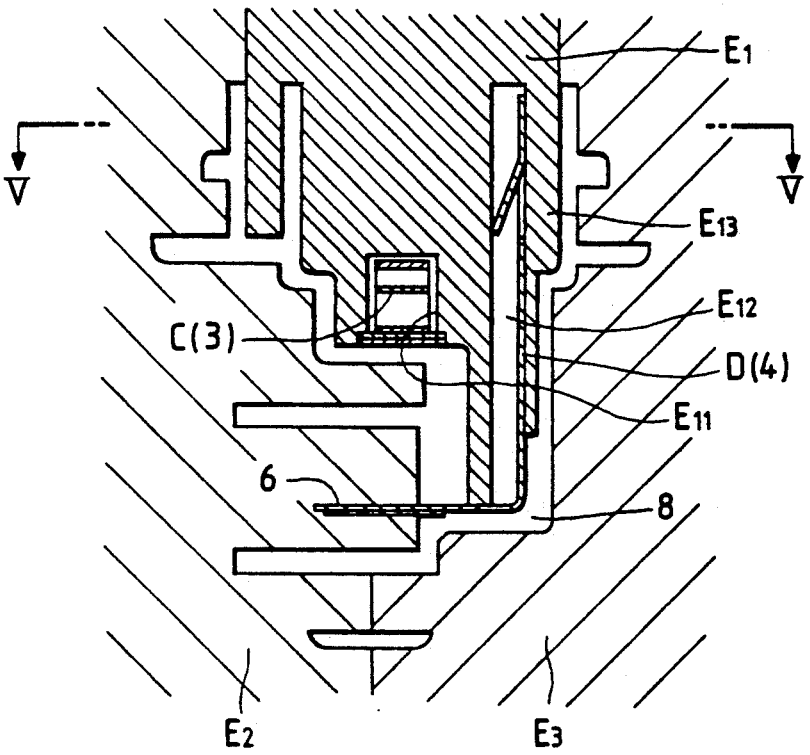
FIG. 4 is a cross-sectional view showing a die for molding the bulb socket of the first embodiment of the present invention.
Figure 5:
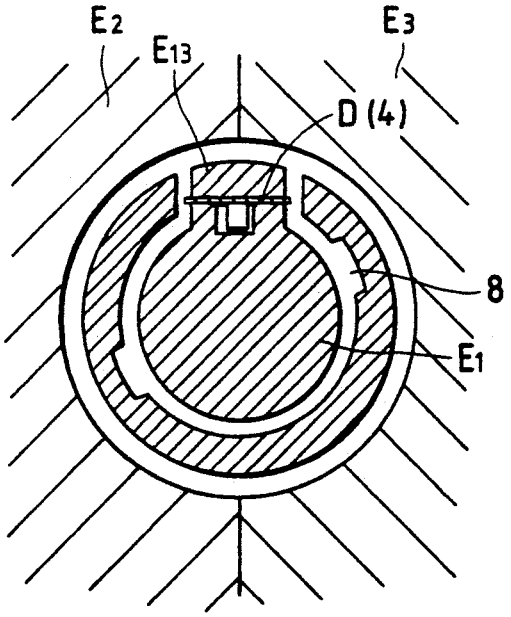
FIG. 5 is a cross-sectional view taken along the line V—V of FIG. 4.

FIGS. 1–5 show a first embodiment of the present socket according to a first embodiment of the present invention, FIG. 2 is a cross-sectional view taken along the line II—II of FIG. 1 with a bulb and a connector, FIG. 3 is a cross-sectional view taken along the line III—III of FIG. 1 with the bulb, FIG. 4 is a cross-sectional view showing a die for molding the bulb socket of the first embodiment of the present invention and FIG. 5 is a cross-sectional view taken along the line V—V of FIG. 4.

In the first embodiment, a socket body A formed of a resin has a bulb insertion hole 1 for fitting therein a bulb B (double-dashed line), and a connector connecting hole 2 for fitting therein a connector F (double-dashed line). The direction of the bulb insertion hole 1 and that of the connector connecting hole 2 are substantially perpendicular and thus the socket body A is integrally and generally L-shaped.

The bulb insertion hole 1 is provided with an inner peripheral wall 11 for directly supporting the bulb B, and an outer peripheral wall 12 for mounting to a socket-mounting opening of a lamp assembly. A J-shaped slot 14 for retaining a mounting pin $B_1$ of the bulb B is formed on an inner surface 11*a* of the inner peripheral wall 11. A bayonet 15 and a flange 16 adapted to engage with the socket mounting member of the lamp assembly are formed integrally with the outer peripheral wall 12 and project therefrom. A seal ring 30 formed of rubber may be fitted on the flange 16 to thereby obtain a sealability between the socket body and the lamp assembly. An engaging hole 21 for engaging with the connector F by an integral engaging projection 22 is provided on the bottom portion of the connector connecting hole 2.

A positive terminal C and an earth terminal D are embedded integrally in the socket body A by injection molding, these two terminals C and D extending from the bulb insertion hole 1 to the connector connecting hole 2 side. Both a bulb contact portion 3 of the positive terminal C and a bulb contact portion 4 of the earth terminal D are disposed in the interior of the bulb insertion hole 1. On the other hand, a connector contact portion 5 of the positive terminal C and a connector contact portion 6 of the earth terminal D are disposed in the interior of the connector connection hole 2.

In the illustrated embodiment, although the bulb socket is for use with a single filament-type bulb having one positive terminal C, the invention may similarly be applied to the type of bulb socket for use with a double filament-type bulb having two positive terminals.

Each of the positive terminal C and the earth terminal D is formed of a single electrically-conductive metal sheet by bending same. That is, the positive terminal C is unitary provided with the bulb contact portion 3 for electrically connecting to the bulb B and the connector contact portion 5 for electrically connecting to the connector F. Similarly, the earth terminal D is unitary provided with the bulb contact portion 4 for electrically connecting to the bulb B and the connector contact portion 6 for electrically connecting to the connector F.

Each of the positive terminal C and the earth terminal D is integrally embedded into the socket body by an injection molding in such a manner that the bulb contact portion 3 of the positive terminal C is disposed at substantially the bottom center of the bulb insertion hole 1. Further, at least a part of the bulb contact portion 4 of the earth terminal D is disposed between the inner peripheral wall 11 and the outer peripheral wall 12 of the bulb insertion hole 1. As shown in FIG. 4, a space portion 7 for receiving a die $E_{13}$ for molding the socket body A as shown in FIG. 2 is formed between the bulb contact portion 4 of the earth terminal D and the outer peripheral wall 12.

During the molding process, as shown in FIGS. 4 and 5, the bulb contact portion 3 of the positive terminal C is inserted into a bottom recess $E_{11}$ of a core die $E_1$ (one of dies $E_1$, $E_2$ and $E_3$ for molding the socket body A). Further, the bulb contact portion 4 of the earth terminal D is inserted into a side recess $E_{12}$ of the core die $E_1$. The bulb contact portion 4 of the earth terminal D comes into abutment against the inner wall of the side recess $E_{12}$ of the core die $E_1$ as shown in FIGS. 4 and 5.

In this condition, the die $E_2$ and the die $E_3$ are mated together with the core die $E_1$ interposed therebetween, thereby forming a cavity 8 into which a molten resin is injected to thereby fill the cavity 8. As a result, the bulb insertion hole 1 and the connector connection hole 2 of the socket body A are formed, and the positive terminal C and the earth terminal D are integrally provided in the socket body A, and that portion corresponding to the outer wall portion $E_{13}$ of the side recess $E_{12}$ in the core die $E_1$ forms the space portion 7.

While the molten resin is injected into a cavity 8 formed by the dies $E_1$, $E_2$ and $E_3$, the earth terminal D is not deformed by the pressure of the resin since the terminal D is fully supported by a die $E_{13}$ at a back thereof.

Figure 6:
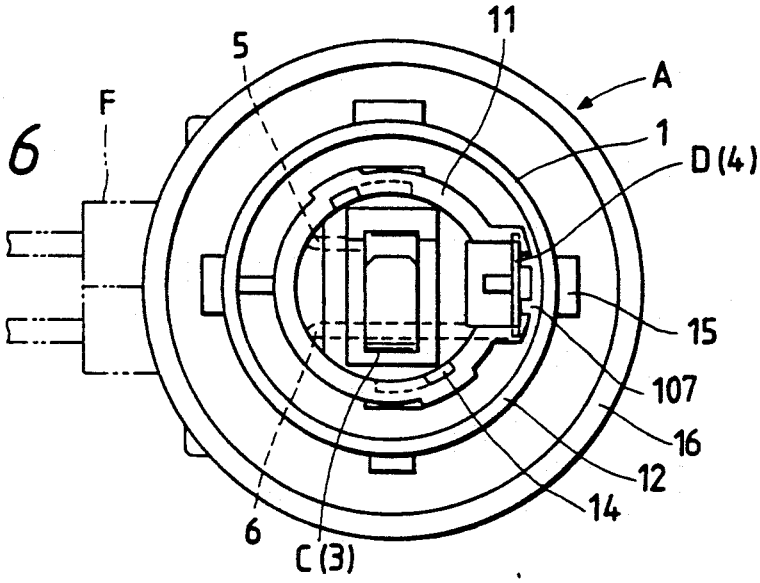
FIG. 6 is a plan view of a valve socket according to the second embodiment of the present invention.
Figure 7:
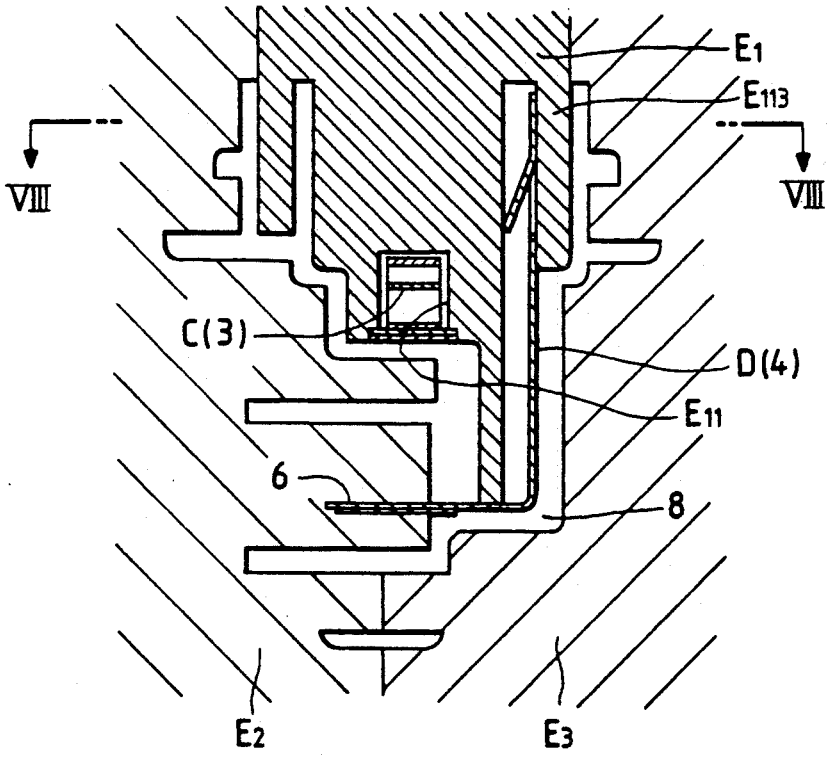
FIG. 7 is cross-sectional view showing a die for molding a bulb socket of the second embodiment of the invention.
Figure 8:
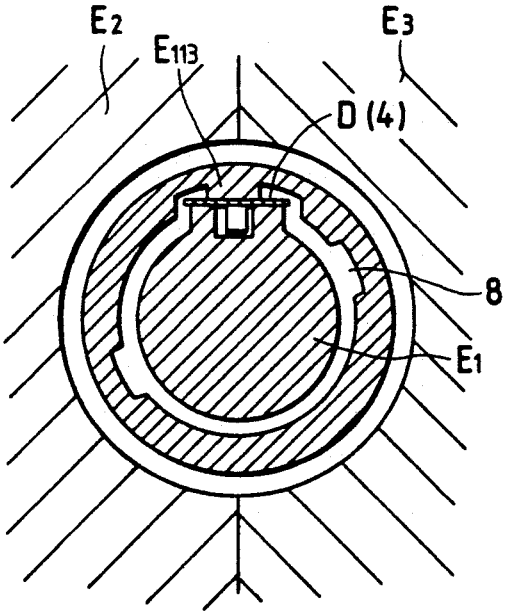
FIG. 8 is a cross-sectional view taken along the line VII—VII of FIG. 7.

FIGS. 6–8 show a second embodiment of the invention. Specifically, FIG. 6 is a plan view of a valve socket according to the second embodiment of the present invention, FIG. 7 is cross-sectional view showing a die for molding a bulb socket of the second embodiment of the invention, and FIG. 8 is a cross-sectional view taken along the line VII—VII of FIG. 7. In FIGS. 6 to 8, same parts and components as that of the first embodiment are designated by the same reference numerals.

According to the second embodiment, as shown in FIGS. 7 and 8, a die $E_{113}$ supports the earth terminal D at an upper part and a center part of the terminal D so that the molten resin injected into the cavity 8 embeds the terminal D surrounding both edges thereof as shown in FIG. 6.

According to the second embodiment, as shown in FIGS. 7 and 8, an outer wall portion $E_{113}$ of the side recess $E_{12}$ in the core die $E_1$ partially but directly supports the bulb contact portion 4 of the earth terminal D. Therefore, the bulb socket body A is provided with a space portion 107 shown in FIG. 6 formed between the bulb contact portion 4 and the outer wall 12 of the socket body A.

With the above construction of the bulb socket according to the present invention, when the terminals are embedded in the socket body during the injection molding process, the bulb contact portion of the earth terminal can directly be supported and reinforced by the socket body-forming die itself. Therefore, even when the bulb contact portion of the earth terminal receives the resin pressure during the molding, the bulb contact portion will not be deformed and, therefore, the yield rate of products can greatly be increased.

What is claimed is:

1. A bulb socket for mounting a bulb, comprising:

a socket body having a bulb insertion hole and a connector connecting hole, said socket body being formed by injection molding;

at least one positive terminal having a bulb contacting portion partially extending into said bulb insertion hold of said body for electrically connecting to the bulb, and a connector contacting portion partially extending into said connector connecting hole for electrically connecting to a connector, said positive terminal being unitary embedded in said socket body during said injection molding of said socket body; and an earth terminal having a bulb contacting portion partially extending into said bulb insertion hole of said body for electrically connecting to the bulb, and a connector contacting portion partially extending into said connector connecting hole for electrically connecting to the connector, said earth terminal being unitary embedded in said socket body during said injection molding of said socket body;

a die insertion space portion being provided in said socket body at a back side of said bulb contacting portion of said earth terminal for preventing contact between said back side of said bulb contacting portion and any injected resin during injection molding of said socket body by insertion of a die wall therebetween.

2. The bulb socket of claim 1, wherein a pair of said connecting terminals are provided for making electrical connections to the bulb.

3. The bulb socket of claim 1, wherein each of said positive terminal and said earth terminal is constituted by bending a single metal plate.

4. The bulb socket of claim 1, wherein said socket body is substantially L-shaped so that a direction of said bulb insertion hole and that of said connector connecting hole are perpendicular.

5. The bulb socket of claim 1, wherein said die insertion space portion is provided at substantially the entire back side of said bulb contacting portion of said earth terminal.

6. The bulb socket of claim 1, wherein said die insertion space portion is provided at an upper center of the back side of said bulb contacting portion of said earth terminal.

7. The bulb socket of claim 1, wherein said socket body comprises:

an inner peripheral wall for receiving the bulb;

a substantially J-shaped slot provided on an inner surface of said inner peripheral wall for retaining a mounting pin of the bulb;

an outer peripheral wall for mounting to a socket mounting opening of the lamp assembly;

a bayonet provided integrally on said outer peripheral wall and projecting therefrom;

a flange provided integrally on said outer peripheral wall and projecting therefrom;

a connector connecting hole for receiving a connector; and an engaging projection provided integrally on said connector connecting hole for engaging with the connector.

8. The bulb socket of claim 7, further comprising a seal ring fitted on said flange for sealing between the bulb socket and the lamp assembly.

* * * * *